US011350717B2

(12) United States Patent
Dalton

(10) Patent No.: US 11,350,717 B2
(45) Date of Patent: Jun. 7, 2022

(54) FOOTWEAR CARRYING SYSTEM

(71) Applicant: Elizabeth Yolanda Dalton, Portland, OR (US)

(72) Inventor: Elizabeth Yolanda Dalton, Portland, OR (US)

(73) Assignee: SWings Products, LLC, Portland, OR (US)

( * ) Notice: Subject to any disclaimer, the term of this patent is extended or adjusted under 35 U.S.C. 154(b) by 458 days.

(21) Appl. No.: 16/235,408

(22) Filed: Dec. 28, 2018

(65) Prior Publication Data

US 2019/0133282 A1 May 9, 2019

Related U.S. Application Data

(63) Continuation of application No. 15/794,274, filed on Oct. 26, 2017, now Pat. No. 10,165,841.

(60) Provisional application No. 62/414,177, filed on Oct. 28, 2016.

(51) Int. Cl.

| | |
|---|---|
| ***A45C 13/30*** | (2006.01) |
| ***A45C 7/00*** | (2006.01) |
| ***A45C 3/12*** | (2006.01) |
| ***A45F 3/04*** | (2006.01) |
| *A45F 3/00* | (2006.01) |

(52) U.S. Cl.

CPC ..... *A45C 13/30* (2013.01); *A45C 3/12* (2013.01); *A45C 7/0086* (2013.01); *A45F 3/04* (2013.01); *A45F 2003/001* (2013.01)

(58) Field of Classification Search

CPC ..... A45C 3/12; A45C 7/0086; A45C 13/30; A45F 2003/001; A45F 3/04

USPC ..... 206/278

See application file for complete search history.

(56) References Cited

U.S. PATENT DOCUMENTS

| | | | | | |
|---|---|---|---|---|---|
| 1,974,156 | A * | 9/1934 | Hockmeyer | A45C 3/12 | 206/278 |
| 2,446,368 | A * | 8/1948 | Haberstump | A47L 15/248 | 134/78 |
| 4,974,709 | A * | 12/1990 | Furlow | A45C 3/00 | 150/111 |
| 5,456,353 | A * | 10/1995 | Challoner | A43B 5/0425 | 206/292 |
| 6,869,219 | B1 * | 3/2005 | Sala | A45C 3/12 | 150/111 |
| 7,322,477 | B2 * | 1/2008 | Schweitz | A63B 60/58 | 206/579 |
| 9,516,935 | B2 * | 12/2016 | Rorie | A45C 7/0086 | |
| 10,165,841 | B2 * | 1/2019 | Dalton | A45C 3/12 | |

(Continued)

*Primary Examiner* — Sue A Weaver

(57) ABSTRACT

A footwear carrying system may include first and second separate carriers, each having a first attachment point near a first end of the carrier, a second attachment point near a second end of the carrier opposite the first end, and a third attachment point along a side of the carrier. A first strap may be adapted to connect the first and second attachment points of the first carrier, and a second strap may be adapted to connect the first and second attachment points of the second carrier. The third attachment points of the first and second carriers may be adapted to connect the first and second carriers together. The carriers may be suspended from one or more shoulders of a wearer, or attached to another carrier using the straps or a connection between the first and second carriers.

19 Claims, 15 Drawing Sheets

(56) References Cited

U.S. PATENT DOCUMENTS

| | | | | |
|---|---|---|---|---|
| 2005/0103817 | A1* | 5/2005 | Glankler | A45C 7/0086<br>224/583 |
| 2006/0185993 | A1* | 8/2006 | Wilskey | B65D 77/042<br>206/278 |
| 2006/0207960 | A1* | 9/2006 | Bastero Lopez | B65D 55/022<br>215/331 |

* cited by examiner

FOOTWEAR CARRYING SYSTEM

CROSS-REFERENCE TO RELATED APPLICATIONS

This application is a continuation of U.S. patent application Ser. No. 15/794,274 filed Oct. 26, 2107, now issued as U.S. Pat. No. 10,165,841, which claims priority from U.S. Provisional Patent Application No. 62/414,177 filed Oct. 28, 2016 titled SWings which is incorporated by reference.

BACKGROUND

Shoes are special. Shoes are necessities of course. But more than any other article of clothing, shoes have the ability to evoke strong feelings in people who own, wear and desire shoes. Shoe obsessions are well known in society today, and sneaker culture has many people buying, selling, trading and coveting shoes.

People have different shoes for different activities like sports, dance, socializing, etc. People want to protect the integrity of their shoes when they are being carried to these activities. But people also want to show off their shoes. Shoes may be seen as an expression of a person's individuality, but this expression ends when shoes are carried around in tote bags, backpacks, gym bags, and even plastic shopping bags.

Shoes don't pack well with other clothing and personal items because they are rigid and bulky. Shoes are also a problem to pack because they are exposed to dust, dirt, mud, chewing gum, and other waste products.

Many solutions have been devised for carrying shoes around. There are dedicated shoe bags and cases, but these need to be carried in addition to purses, backpacks and other bags, so they are awkward and burdensome to use. Dedicated compartments have been designed into backpacks and other bags, but these reduce the utility of the carriers when not used for shoes, and they have other problems as well. For example, the shoe compartments cannot be laundered separately if waste matter from shoes contaminates the compartments.

A saddle bag style shoe carrier with individual shoe bags is disclosed in U.S. Pat. No. 6,869,219 and sold in a commercial embodiment, but it has limited usefulness because it is only designed to be wrapped around a backpack. This design also tends to squeeze the backpack, thereby making it difficult to load the backpack with additional items or causing the shoe bags to slip if items are removed from the backpack.

Thus, there is a need for something that solves the practical problems of carrying shoes while also letting people show off their shoes and express themselves. There is a need for a product that is worthy of the footwear it carries.

SUMMARY

The inventive principles of this patent disclosure are directed to versatile footwear carrying systems having individual carriers with three or more attachment points that enable the carriers to be attached to backpacks, gym bags, purses, etc. They may also be worn in the manner of a backpack or shoulder bag. The attachment points may be used with various arrangements of straps, harnesses, etc., to enable a user to configure the system in ways that express their personal style, while still preserving the integrity of their shoes or other footwear.

BRIEF DESCRIPTION OF THE DRAWINGS

To the extent that embodiments shown in different figures include the same or similar components, the same reference numbers may be used.

DETAILED DESCRIPTION

Figure 1:
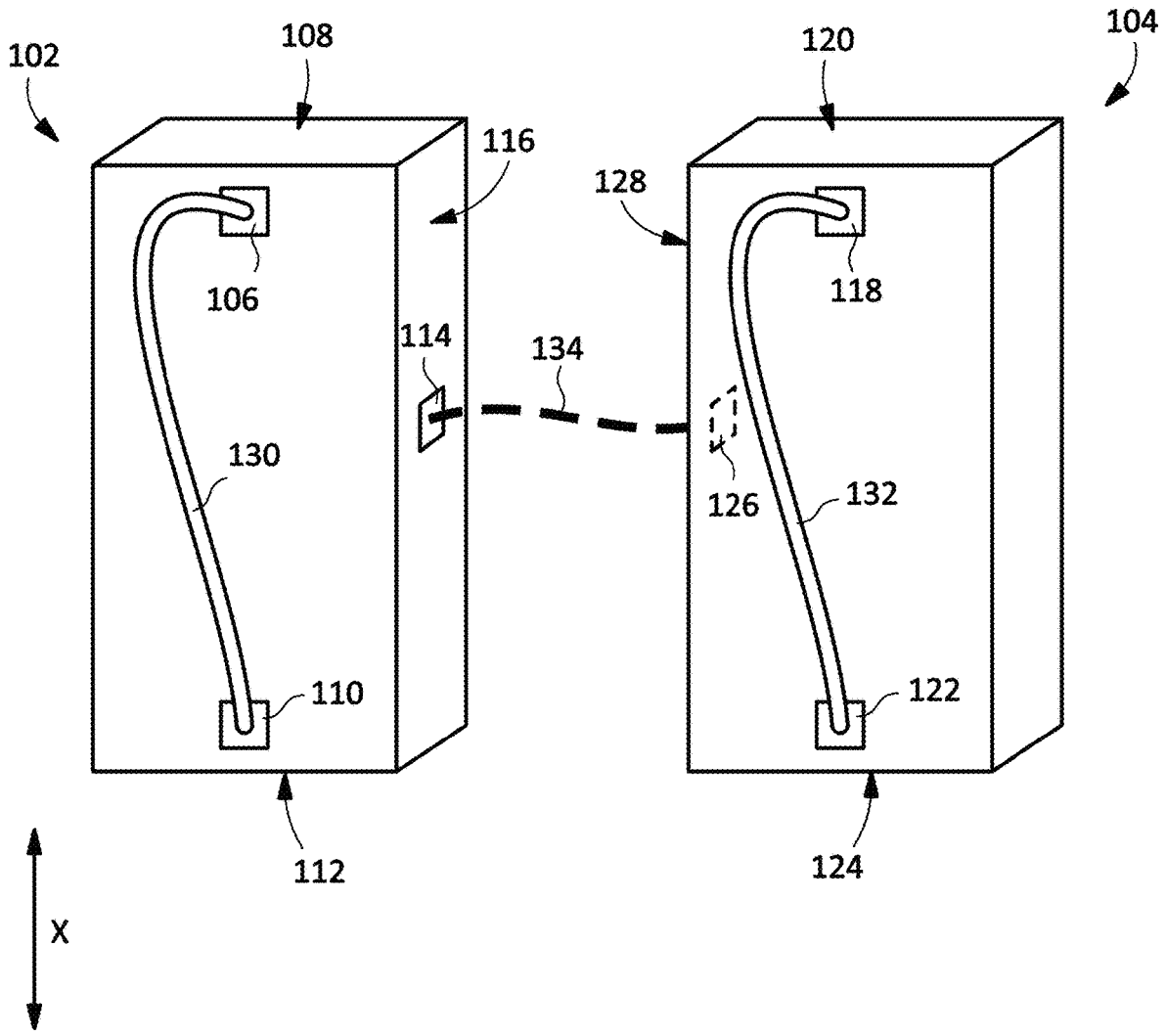
FIG. 1 illustrates a first embodiment of a footwear carrying system according to the inventive principles of this patent disclosure.

FIG. 1 illustrates a first embodiment of a footwear carrying system having separate footwear carriers according to the inventive principles of this patent disclosure. The embodiment of FIG. 1 is shown in a schematic form using simplified and/or symbolic elements to disclose the general inventive principles. More detailed embodiments will be described below. The system of FIG. 1 includes first and second footwear carriers 102 and 104, each of which has an elongated shape and is intended to hold a shoe or other item of footwear.

The first carrier 102 has a first attachment point 106 near the top end 108 of the carrier, a second attachment point 110 near the bottom end 112 of the carrier, and a third attachment point 114 along a side 116 of the carrier.

The second carrier 104 has a first attachment point 118 near the top end 120 of the carrier, a second attachment point 122 near the bottom end 124 of the carrier, and a third attachment point 126 along a side 128 of the carrier.

A first shoulder strap 130 may be connected between the first and second attachment points 106,110 of the first carrier 102, and a second shoulder strap 132 may be connected between the first and second attachment points 118,122 of the second carrier 104.

The third attachment points 114,126 of the first and second carriers 102,104 are adapted to connect the first and second carriers together as shown by dashed line 134.

As illustrated in FIG. 1, the straps 130,132, are generally oriented in the direction of the long axis X of each of the carriers 102,104. In some modes of use, the straps 130,132 may be used to suspend the carriers 102,104 from a user's shoulders or from another carrying article such as a backpack or bicycle bag, while the connection 134 merely connects the carriers 102,104 together. In this mode, the carriers are oriented in a generally vertical direction, i.e., the long axis X of each of the carriers 102,104 is roughly vertical as will be described in more detail below.

In other modes of use, the connection 134 may be used to suspend the carriers 102,104 from another carrying article such as a purse, a duffle bag, or bicycle rack trunk, while the straps 130,132 may be unused, removed, or used to provide supplemental attachment points. In this mode, the carriers are oriented in a generally horizontal direction, i.e., the long axis X of each of the carriers 102,104 is roughly horizontal as will be described in more detail below.

The carriers 102,104 are shown as boxes in FIG. 1 for simplicity, but they may be implemented in many other forms including cylinders, prisms, pyramids or other regular or irregular geometric shapes. In practical implementations, the carriers may be realized in the general shape of a shoe, boot, sandal or other type of footwear as described in more detail below. The carriers 102,104 may be fabricated from any suitable rigid, semi-rigid or flexible materials such as canvas, nylon, polyester, leather, etc., that are preferably resistant to, impervious to, and/or impenetrable by, water, UV light, etc.

The straps 130,132 and attachment points 106,110,118, 122 may be implemented in a wide variety of ways. In simple implementations, the straps 130,132 may be made from webbing, cord or any other suitable material that is glued, sewn, riveted or otherwise attached directly to spots on the carriers 102,104 which serve as the attachment points. The straps 130,132 may include optional buckles, clips, or other devices that enable each strap to be adjusted and/or split into two parts to enable the strap to be passed through the handle of a backpack or other article and then reconnected as described in more detail below.

In more sophisticated implementations, the straps 130, 132 and attachment points 106,110,118,122 may be realized with various combinations of devices and materials that provide more versatility. For example, the attachment points 106,110,118,122 may be implemented with loop devices such as sewn fabric loops and/or D-rings, and the straps 130,132 may be made from nylon webbing with swivel snaps at one or both ends to enable the straps to be removed and reconnected to the attachment points. Other hardware and arrangements such as slides, buckles, hook- and loop fasteners, adjusters, clips, strap loops, strap hooks, etc., may be used to provide adjustability in the length and positioning of the straps, as well as to enable the straps to be easily attached to and removed from the carriers themselves and/or other carrying articles.

The connection 134 between the two carriers 102,104 may also be implemented in a wide variety of ways. In a simple implementation, the connection 134 may be made permanently from a short piece of webbing or cord that is sewn directly to spots on the carriers 102,104 which serve as the attachment points 114,126. In an even simpler form, the connection 134 may be formed permanently by directly sewing the two carriers 102,104 together along portions of the sides 116,128 of the carriers that serve as the attachment points 114,126, wherein the portions are short enough to allow the carriers to retain their individual characteristic. In this form, the sides 116,128 of the carriers may be made from fabric that is optionally cut to form protrusions at the attachment points 114,126. In another implementation, the attachment points 114,126 may be fabricated from loops of webbing sewn to the carriers 102,104, and the connection 134 maybe realized with a strap hook that is permanently sewn into the loop on one carrier and removably attachable to the loop on the other carrier using the open arm of the strap hook. In yet another implementation, the strap hook may be replaced with, for example, a side release buckle, also known as a parachute clip.

The connection 134 between the two carriers 102,104 may be located at any suitable location along the sides 116,128 of the carriers, for example, near the midway point between the ends, or somewhat higher toward the top ends of the carriers. Some embodiments may include one or more additional connections between the carriers that are spaced apart at suitable locations along the sides 116,128 of the carriers. The additional connections may be especially useful for embodiments that are likely to be used frequently in horizontal modes.

Each of the carriers 102,104 includes one or more openings (not shown in FIG. 1) for inserting and removing footwear. In some implementations, the opening may be located at the top end of each carrier and covered or closed with a flap, a lid, or other form of cover or closure and secured with snaps, buttons, zippers, hook-and-loop tape, or any other suitable fastener. The opening may alternatively, or in addition, be covered by a sleeve with a drawstring closure mechanism. In other implementations, the opening may be located along any side of the carrier and covered and/or closed with any suitable arrangement of doors, flaps, covers, fasteners, etc.

The embodiment of FIG. 1 may further include numerous other features such as: pockets to store personal items like electronic devices or to store straps, harnesses or other components of the footwear carrying system when they are not in use; passageways and additional openings to accommodate wiring for electronic devices; additional openings for drainage and ventilation; cleat protectors and other devices to protect the carriers 102,104 from spikes, cleats and other sharp objects; cross-straps to form a more complex harness from the two straps 130,132; and additional attachment points for various accessories such as those described next.

The attachment points illustrated in FIG. 1 are shown on specific sidewalls of the carriers for purposes of general illustration, but in some implementations of this or any other embodiment, they may be located on different sidewalls and/or at the seams or junctions between sidewalls, and some implementations may not have four sidewalls.

Figure 2:
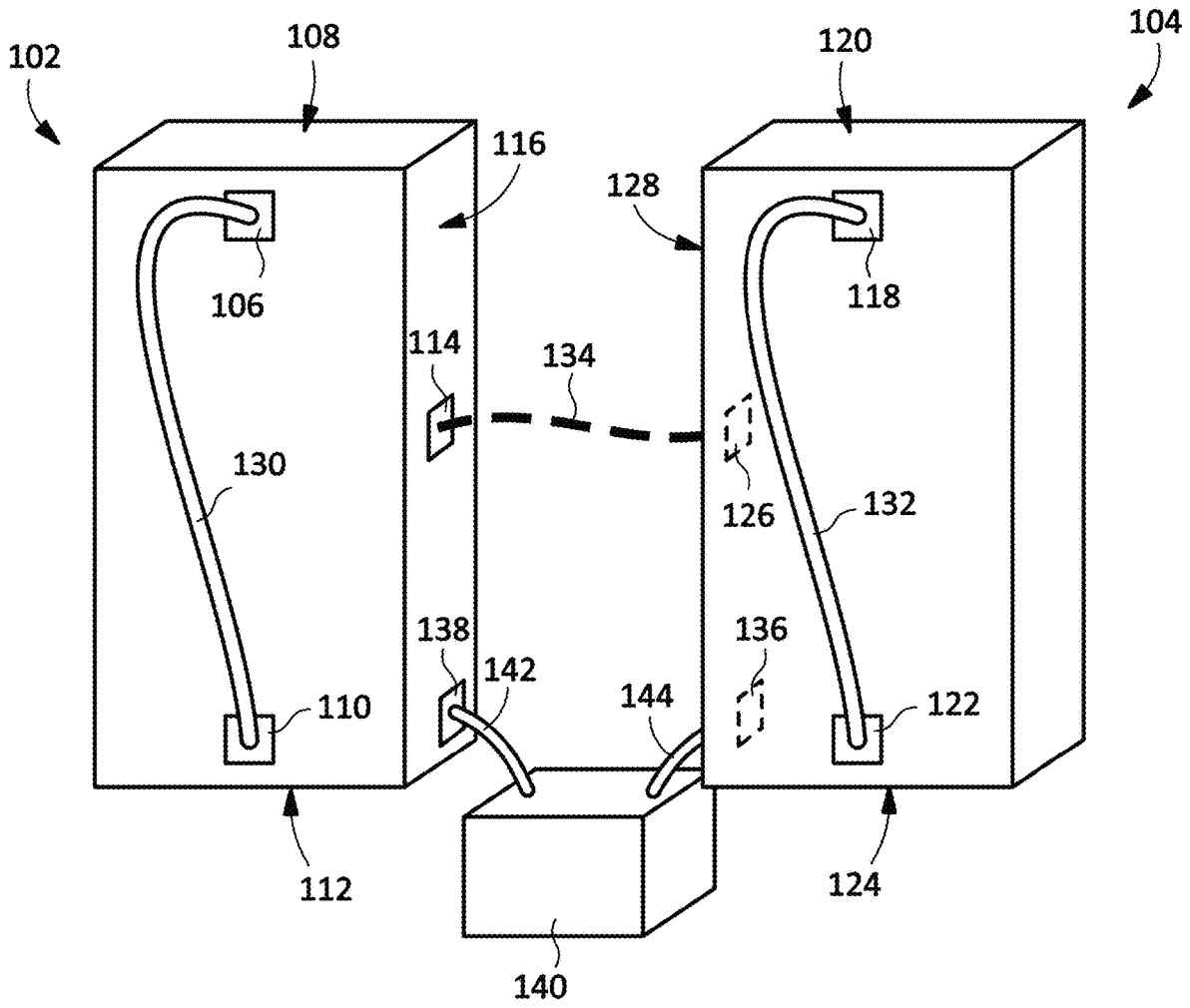
FIG. 2 illustrates another embodiment of a footwear carrying system having additional attachment points according to the inventive principles of this patent disclosure.

FIG. 2 illustrates another embodiment of a footwear carrying system having additional attachment points to accommodate an accessory carrier according to the inventive principles of this patent disclosure. The embodiment of FIG. 2 is also shown in a schematic form using simplified and/or symbolic elements to disclose the general inventive principles. More detailed embodiments will be described below.

In the system of FIG. 2, the first carrier 102 has a fourth attachment point 136 near the bottom end 112 of the carrier, and the second carrier 104 has a fourth attachment point 138 near the bottom end 124 of the carrier. The fourth attachment points 136,138 provide a place for attaching an accessory carrier 140 which may be suspended between the carriers 102,104. The accessory carrier 140 includes a first attachment device 142 adapted to connect to the fourth attachment point 136 of the first carrier 102 and a second attachment device 144 adapted to connect to the fourth attachment point 138 of the second carrier 104.

The accessory carrier 140 may have various useful configurations such as a wrap, sleeve, or pouch for holding a water bottle, a small duffle bag for holding additional personal items such as socks or other articles of clothing, a ball carrier, etc. The fourth attachment points 136,138 and attachment devices 142,144 may be implemented in a wide variety of ways. In simple implementations, the attachment devices 142,144 may be made from webbing or cord that is sewn directly and permanently to spots on the carriers 102,104 which serve as the attachment points 136,138. In other implementations, the attachment points 136,138 and attachment devices 142,144 may be realized with various combinations of devices and materials that provide more versatility. For example, the attachment points 136,138 may be implemented with loop devices such as sewn fabric loops and/or D-rings, and the attachment devices 142,144 may be implemented as swivel snaps that are attached to the accessory carrier 140 with webbing. The swivel snaps enable the accessory carrier 140 to be removed from and reattached to the carriers 102,104 as needed.

As with the embodiment of FIG. 1, the attachment points illustrated in FIG. 2 are shown on specific sidewalls of the carriers for purposes of general illustration, but in some implementations, they may be located on different sidewalls and/or at the seams or junctions between sidewalls, and some implementations may not have four sidewalls. In alternative embodiments, the attachment points 136,138 may be located near the top ends 108,120 of the carriers 102,104, or anywhere along the lengths of the carriers.

Figure 3:
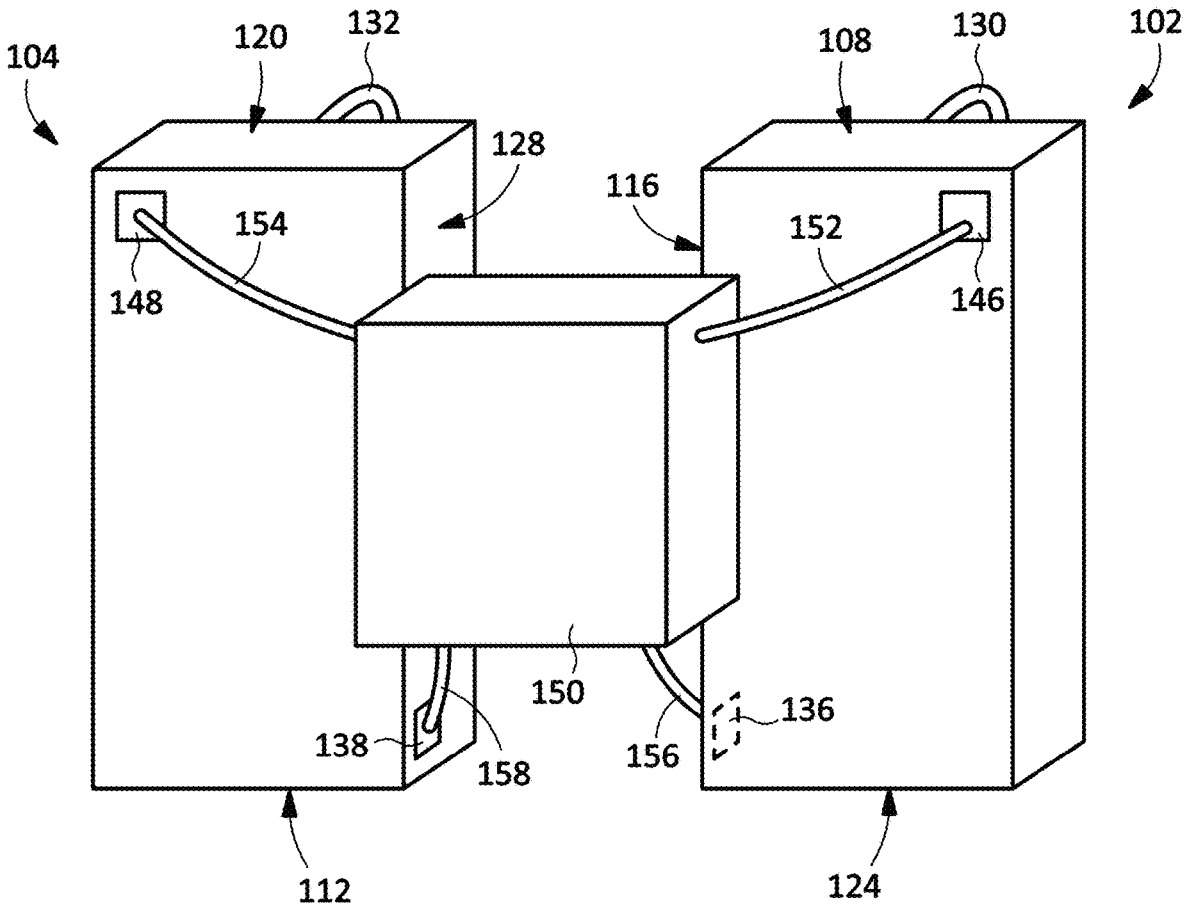
FIG. 3 illustrates another embodiment of a footwear carrying system having additional attachment points according to the inventive principles of this patent disclosure.

FIG. 3 illustrates another embodiment of a footwear carrying system having additional attachment points to accommodate another accessory carrier according to the inventive principles of this patent disclosure. The embodiment of FIG. 3 is also shown in a schematic form using simplified and/or symbolic elements to disclose the general inventive principles. More detailed embodiments will be described below. To the extent that the system of FIG. 3 includes the same components as the systems of FIGS. 1 and 2, the same reference numbers are used.

In FIGS. 1 and 2, the system is shown from the perspective of a viewer looking at the back, that is, the side that rests against the wearer's back when the system is used in a backpack mode. In FIG. 3, the system is shown from the perspective of a viewer looking at the front, that is, the side that faces away from the wearer when the system is used in a backpack mode.

In the system of FIG. 3, the first carrier 102 has a fifth attachment point 146 near the top end 108 of the carrier, and the second carrier 104 has a fifth attachment point 148 near the top end 120 of the carrier. The fifth attachment points 146,148 provide places for attaching another accessory carrier 150 which may be suspended between the carriers 102,104. The accessory carrier 150 includes a first attachment device 152 adapted to connect to the fifth attachment point 146 of the first carrier 102, a second attachment device 154 adapted to connect to the fifth attachment point 148 of the second carrier 104, a third attachment device 156 adapted to connect to the fourth attachment point 136 of the first carrier 102, and a fourth attachment device 158 adapted to connect to the fourth attachment point 138 of the second carrier 104.

The accessory carrier 150 may have various useful configurations such as a mesh panel or pouch to hold a basketball, soccer ball, football, etc. Other possible configurations include a wrap, sleeve, or pouch for holding a water bottle, a small duffle bag for holding additional personal items such as socks or other articles of clothing, etc.

The fifth attachment points 146,148 and the attachment devices 152,154,156,158 may be implemented in a wide variety of ways. In simple implementations, the attachment devices 152,154,156,158 may be made from webbing or cord that is sewn directly and permanently to spots on the carriers 102,104 which serve as the attachment points 146, 148,136,138. In other implementations, the attachment points and attachment devices may be realized with various combinations of devices and materials that provide more versatility. For example, the attachment points 146,148,136, 138 may be implemented with loop devices such as sewn fabric loops and/or D-rings, and the attachment devices 152,154,156,158 may be implemented as snaps that are sewn directly to the accessory carrier 150 or attached with webbing. The snaps enable the accessory carrier 150 to be removed from and reattached to the carriers 102,104 as needed.

In some implementations, the two lower attachment points 136,138 may be omitted, and the lower attachment devices 156,158 on accessory carrier 150 may alternatively be attached to the attachment points 110,122 (not visible in FIG. 3) that are used for the lower ends of the straps 130,132. In some other implementations, the two lower attachment devices 156,158 on accessory carrier 150 may be omitted, in which case, it may be more suitable for the accessory carrier 150 to be realized as a pouch or bag rather than a panel.

As with the embodiments of FIGS. 1 and 2, the attachment points illustrated in FIG. 3 are shown on specific sidewalls of the carriers for purposes of general illustration, but in some implementations of this and other embodiments, they may be located on different sidewalls and/or at the seams or junctions between sidewalls, and some implementations may not have four sidewalls. In alternative embodiments, the attachment points 146,148 may be located near the bottom ends 124,112 of the carriers 102,104, or anywhere along the lengths of the carriers.

Figure 4:
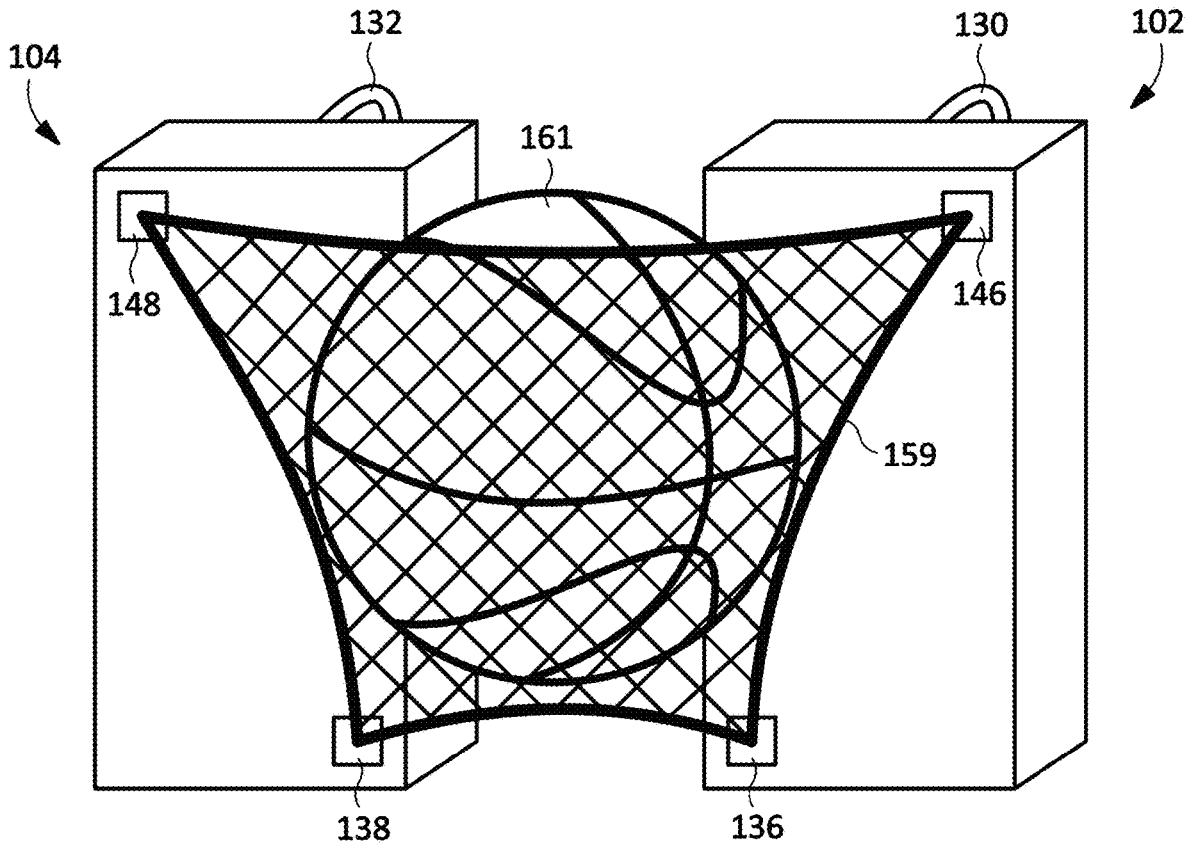
FIG. 4 illustrates another embodiment of a footwear carrying system showing an accessory attached according to the inventive principles of this patent disclosure.

FIG. 4 illustrates an embodiment of a footwear carrying system having a mesh panel 159 to hold a piece of athletic gear 161 such as a basketball, soccer ball, football, etc., according to the inventive principles of this patent disclosure. The carriers 102,104 in the embodiment of FIG. 4 are similar to those of FIG. 3, but the fourth attachment points 136,138 have been moved to the front sidewalls of the carriers 102,104. The mesh panel and attachment points may be implemented with any suitable combination of materials.

For example, the attachment points may be realized with D-rings, and the mesh panel may be attached with swivel snap hooks.

Figure 5:
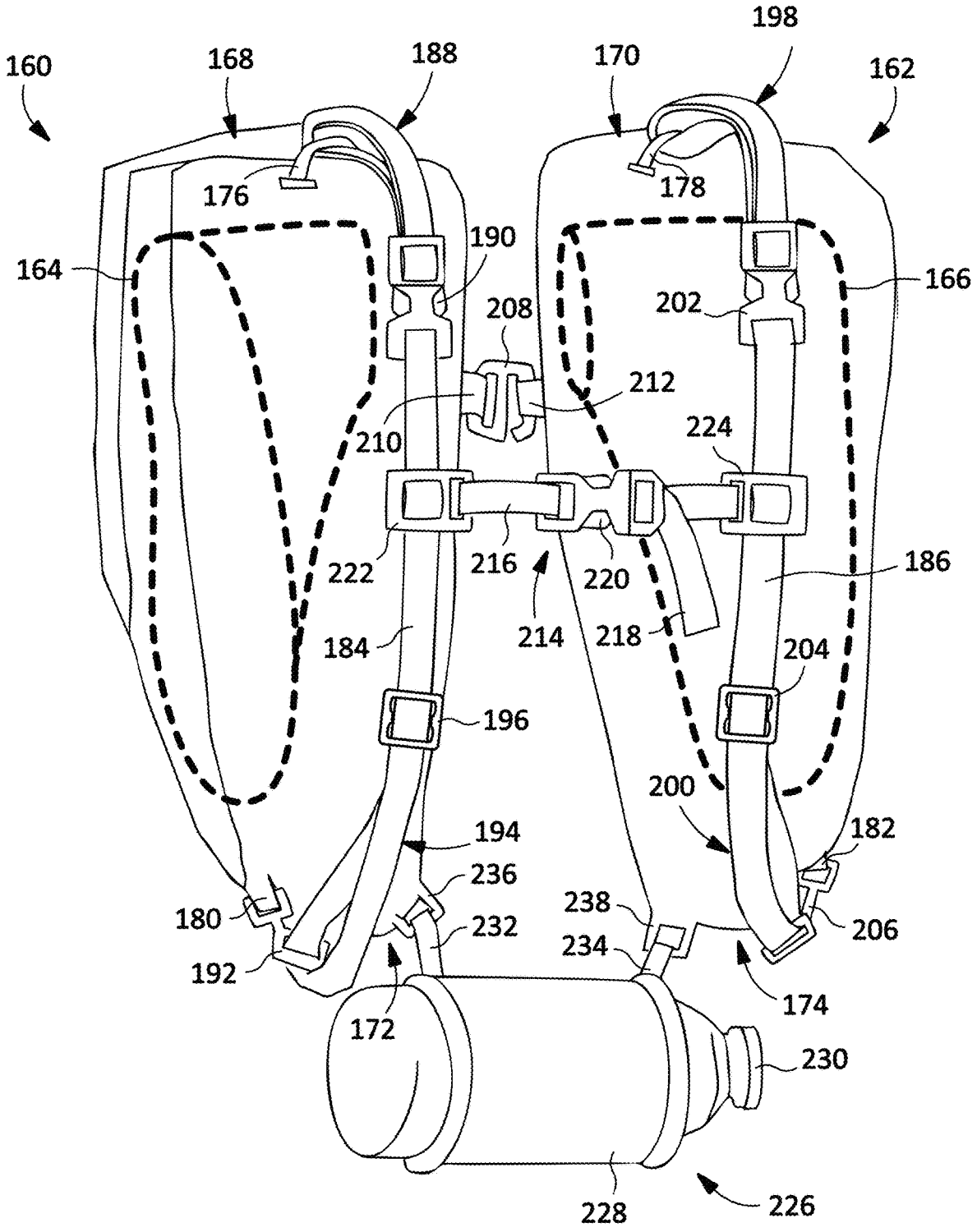
FIG. 5 illustrates another embodiment of a footwear carrying system showing some implementation details according to the inventive principles of this patent disclosure.

FIG. 5 illustrates another embodiment of a footwear carrying system showing how some of the principles illustrated in FIGS. 1-4 may be implemented in more detail according to the inventive principles of this patent disclosure. FIG. 5 is a view looking at the back of the system, that is, the side that rests against the wearer's back when the system is used in a backpack mode.

The system of FIG. 5 includes two carriers 160,162 each of which has the general shape of a shoe 164,166 which is illustrated with broken lines and shown in the position the shoe may be in when inserted in the carrier. In this example, the shoes are shown as high-top sneakers with their soles facing outward away from each other and the long axis of the soles oriented along the long axis of the carrier. The toes of the shoes point downward, and thus, the carriers are wider at the top end 168,170 and taper to a smaller end 172,174 at the bottom. Although this shape conforms to the general shape of high-top sneakers, carriers that are formed in this shape may accommodate footwear having many other shapes. Alternatively, the carriers may be modified to conform to the size and shape of any type of footwear arranged in various orientations.

Each carrier 160,162 is fabricated essentially as a bag from panels of sewn fabric such as canvas, Cordura Nylon, ballistic nylon, rip-stop nylon, polyester pack cloth, leather, etc., using sewing techniques like those used to make purses, backpacks, duffel bags, etc.

Each carrier 160,162 includes a sewn fabric loop attachment point 176,178 at or near the top end 168,170 and a loop of webbing and/or D-ring attachment point 180,182 at or near the bottom end 172,174 to connect shoulder straps 184,186 to the carriers.

The top end of strap 184 is removably attached to fabric loop 176 on carrier 160 using a loop 188 that is formed by passing the strap 184 through one end of a side-release buckle 190 and looping the end of the strap back around to the other end of the buckle 190. The strap 184 may be sewn at each location where it passes through the buckle, or it may be allowed to slide through either or both ends of the buckle for additional adjustability.

The bottom end of strap 184 is removably attached to attachment point 180 using a swivel snap 192 that is held in a loop 194 formed by passing the strap 184 through an adjustable slide 196 and then looping the end of the strap 184 back to the slide 196 where it is sewn to the center bar of the slide.

The other strap 186 constructed in the same manner as strap 184 with upper loop 198, lower loop 200, side release buckle 202, adjustable slide 204 and swivel snap 206. As with the buckles 190,202, the slides 196,204 maybe fastened to the straps 184,198 in various other ways. The connection between the carriers 160,162 is realized with a strap hook 208 (also known as an a-hook because it resembles a lower case letter "a") that is permanently attached to one carrier 160 with a sewn strap or loop of webbing 210 and may be removably attached to the other carrier 162 by hooking the free arm of the strap hook 208 into another strap or loop of webbing 212 that is sewn to the other carrier. This flexible connection arrangement allows the two carriers 160,162 to move, e.g., rotate or pivot, independently of each other so they can form around and adapt to the contour of anything they are attached to.

As with the straps 130,132 in FIG. 1, the straps or loops 210,212 in FIG. 5 may be made from webbing, cord or any other suitable material that is glued, sewn, riveted or otherwise attached directly to spots on the carriers 160,162, or they may be removable. They may include optional buckles, clips, slides, or other devices that enable the connection to be adjusted and/or split into two parts to enable the connection to pass through the handle of a purse, duffle bag, backpack, bicycle rack bag or other article and then reconnected as described in more detail below.

The embodiment of FIG. 5 also includes a sternum strap 214 formed from two pieces of webbing 216,218 connected in the middle by a side-release buckle 220 and attached to the shoulder straps 184,186 with quick-attach sternum slides 222,224. Additional sternum straps may be included to provide additional security, comfort, adjustability, etc. A waist strap may also be included by positioning another sternum strap toward the lower ends of the shoulder straps 184,186. Alternatively, a waist strap may be included by attaching it with snap hooks to the lower attachment points 180,182, or by sewing it directly to the carriers, etc.

The embodiment of FIG. 5 also includes an accessory carrier 226 which in this example is a wrap 228 to hold a bottle 230. The accessory carrier 226 includes attachment devices 232, 234 which in this example are shown as hook-and-loop straps that attach to D-rings 236,238 that serve as accessory attachment points on the carriers 160,162. The wrap in this example uses hook-and-loop fasteners to adjust the diameter of the wrap to securely hold the bottle 230. The wrap may include various accessories such as a zippered pocket and preferably includes a non-slip surface on the inside to prevent the bottle from sliding out of the wrap.

Figure 6:
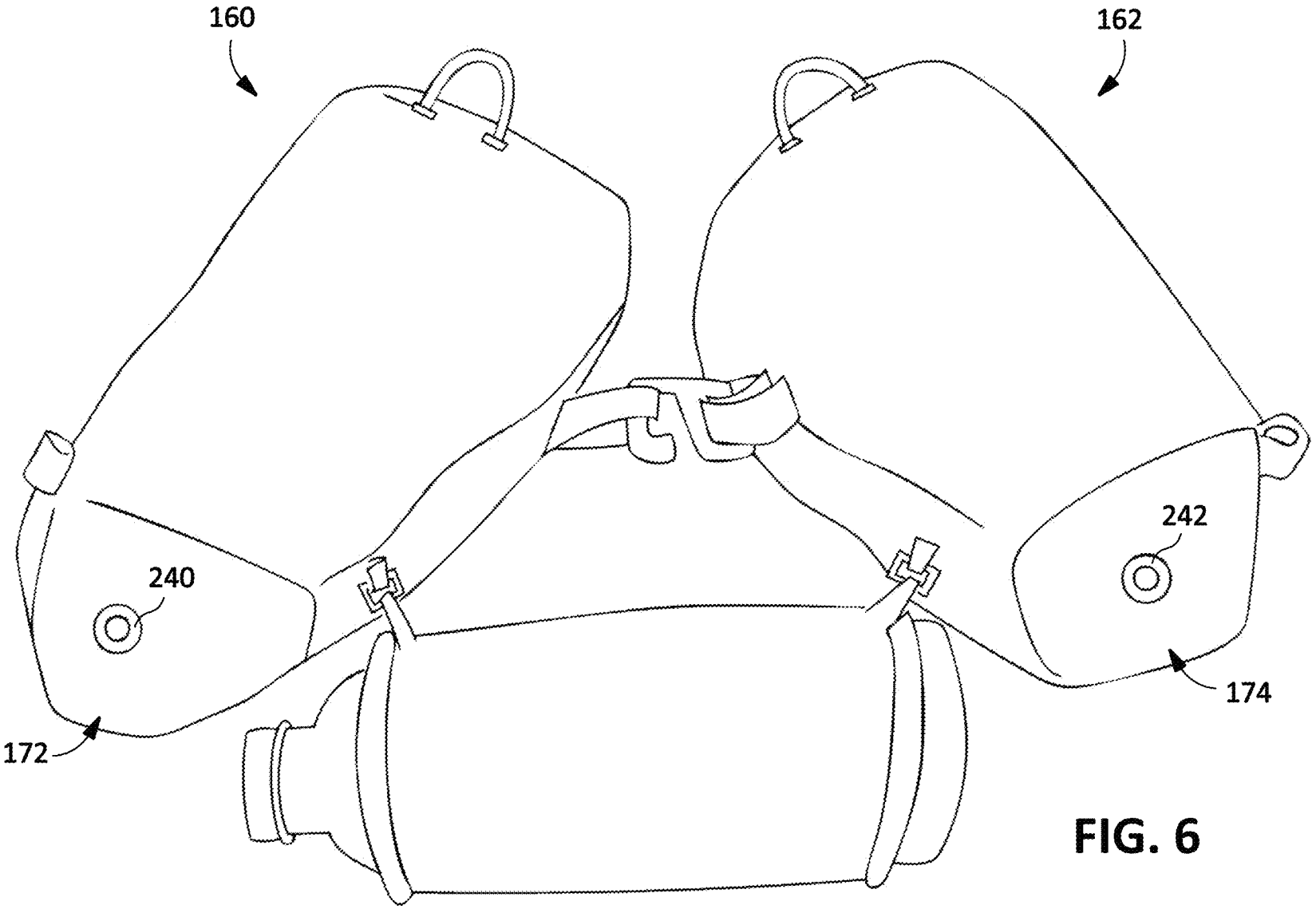
FIG. 6 is another view of the embodiment of FIG. 5.

FIG. 6 is another view of the embodiment of FIG. 5 (without the shoulder and sternum straps) taken from a perspective that shows more of the shape of the bottom ends 172,174 of the carriers 160,162, as well as grommets 240, 242 that provide drainage and ventilation to the carriers.

Figure 7:
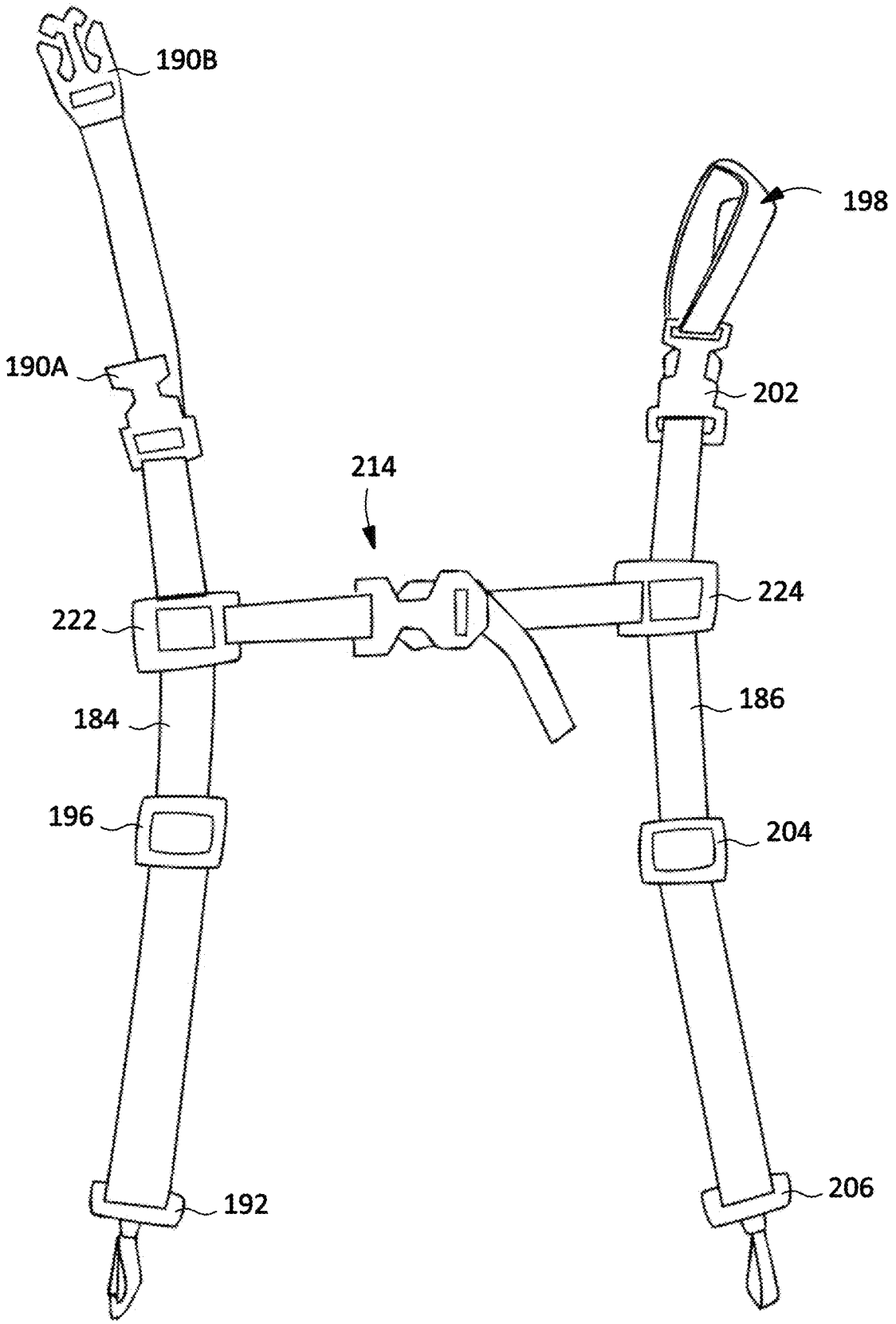
FIG. 7 illustrates an embodiment of a harness according to the inventive principles of this patent disclosure.

FIG. 7 is another view of the harness formed by shoulder straps 184,186 and sternum strap 214 from FIG. 5 showing in more detail how the loops are formed at the top ends of the straps. In this example, the hook (male) end 190B of a side release buckle is sewn to the end of strap 184 and the catch (female) end 190A is sewn to the strap 184 at some distance down from the end so that the strap may be looped back and the hook end 190B inserted into the catch end 190A, thereby forming a loop such as loop 198 shown in the other strap 186 where side release buckle 202 is shown in the engaged position. In this example, neither end 190A,190B of the buckle is adjustable. With the ends 190A,190B of the buckle disconnected as shown in FIG. 7, the top of strap 184 has a general Y-shape with the ends of the buckle forming the tops of the Y.

Figure 8:
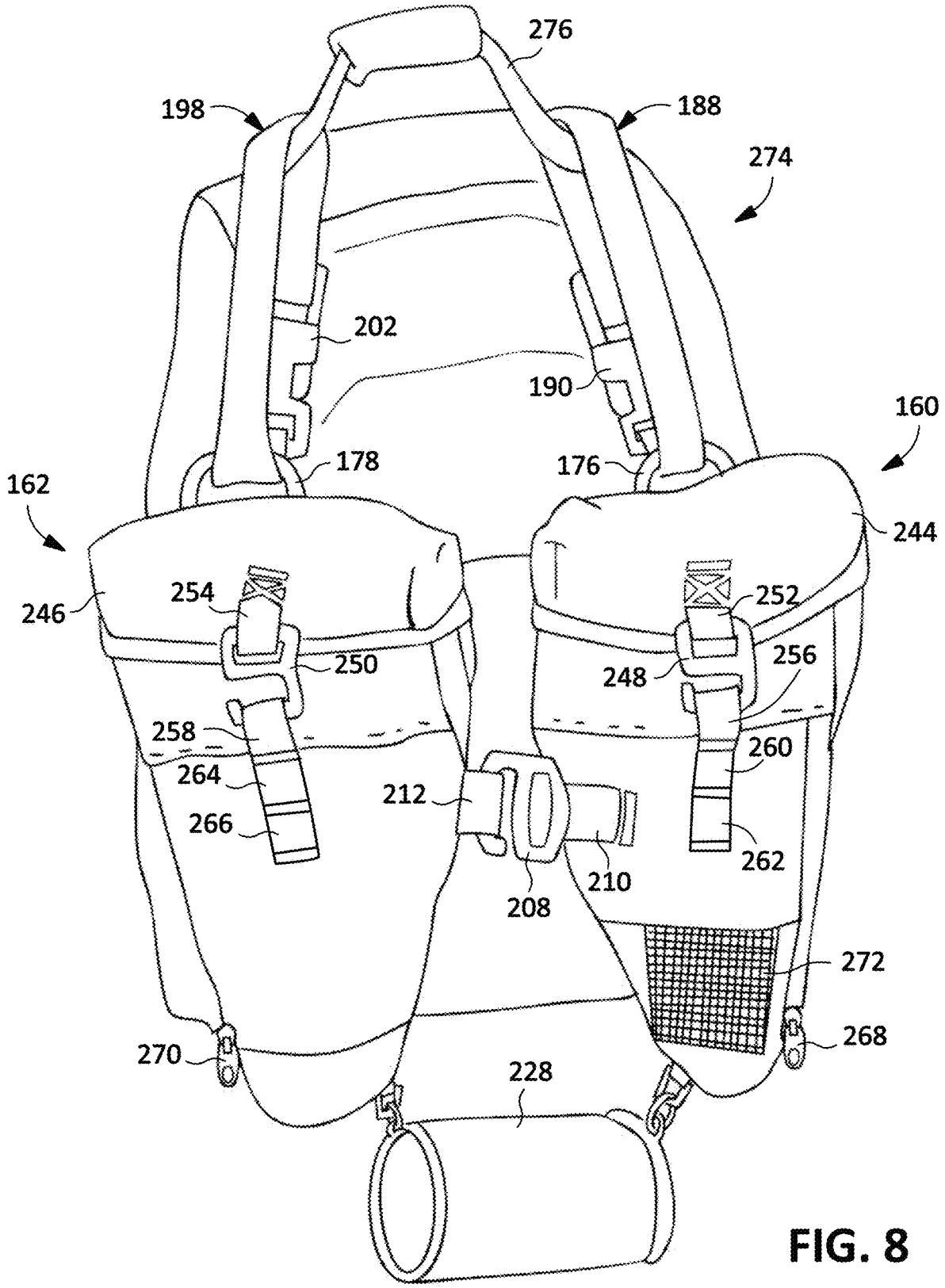
FIG. 8 is another view of the embodiment of FIG. 5 and illustrates some additional implementation details as well as an embodiment of a method for attaching the system to a backpack according to the inventive principles of this patent disclosure.
Figure 9:
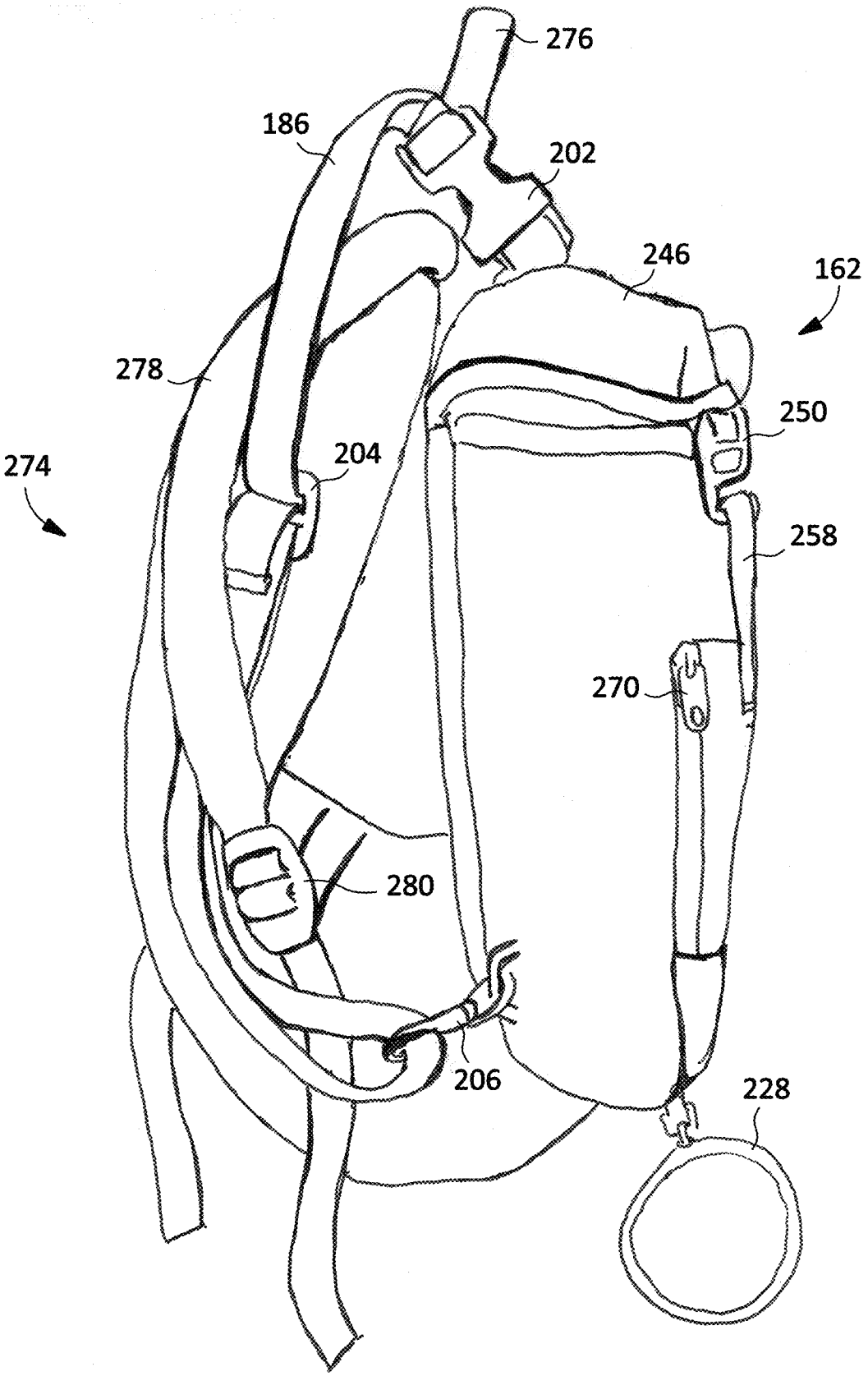
FIG. 9 illustrates another embodiment of a method for attaching a footwear carrying system to a backpack according to the inventive principles of this patent disclosure.
Figure 10:
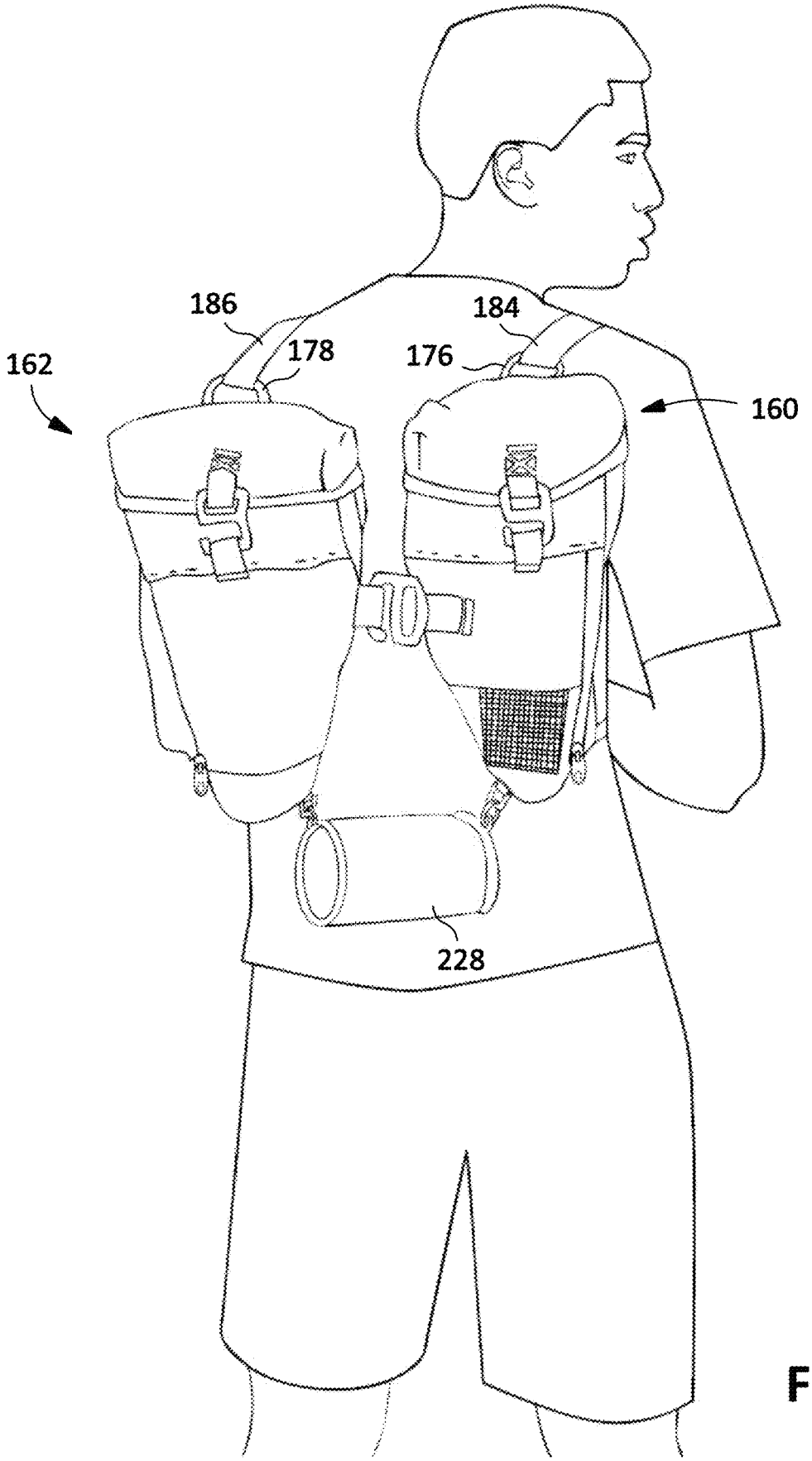
FIG. 10 illustrates an embodiment of a method for wearing a footwear carrying system in the manner of a backpack according to the inventive principles of this patent disclosure.
Figure 11:
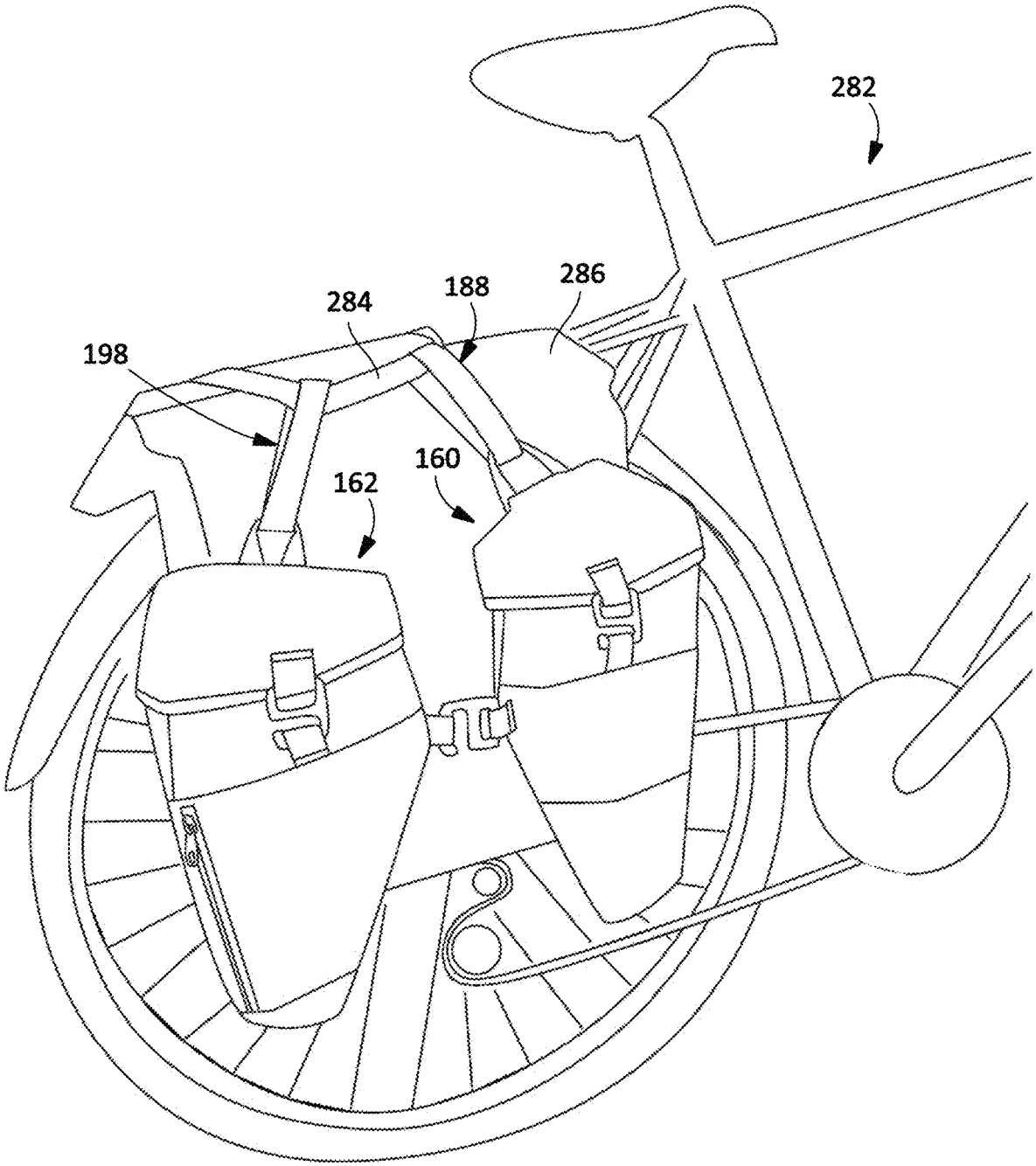
FIG. 11 illustrates an embodiment of a method for suspending a footwear carrying system from a bicycle bag according to the inventive principles of this patent disclosure.

Alternatively, either end 190A or 190B may be made adjustable (single adjust), or both ends may be adjustable (double adjust) to provide additional adjustability in the strap or resulting loop. For example, the catch end 190A may be sewn to the strap 184 at a fixed location, and the hook end 190B may be left free to slide along the end portion of the strap 184. The additional adjustability may be especially useful when using the footwear carrying system in an accessory mode, that is, attaching the system to another carrier such as a backpack as shown in FIGS. 8 and 9 below or to a bicycle saddle bag as shown in FIG. 11 below. It may also be useful when using the footwear carrying system in a backpack mode as shown in FIG. 10 below to provide extra adjustability to the shoulder straps, for example, if the slides 196,204 do not provide enough adjustability.

FIG. 8 is another view of the embodiment of FIG. 5 attached to a backpack according to some inventive principles of this patent disclosure. The view of FIG. 8 is shown looking at the front of the system, that is, the side that faces away from the wearer when the system is used in a backpack mode.

As seen in FIG. 8, each of the footwear carriers 160,162 has a cover 244,246 that can be opened to expose the open end at the top of the carrier where a shoe can be inserted. In this embodiment, the covers 244,246 are hinged to the back panels of the carriers 160,162, but many other types of covers and/or closures may be utilized. The cover of each carrier may be secured in the closed position with a strap hook 248,250 that is permanently attached to the cover 244,246 with a sewn loop of webbing 252,254 and can be hooked onto another loop of webbing 256,258 that is sewn to the front panel of the carrier. Additional loops 260,262, 264,266 may be sewn to the front panels at different locations to allow the covers to be tightened or loosened to accommodate different size footwear. Alternatively, any other number and/or types of fasteners may be used such as snaps, zippers, etc.

The embodiment of FIG. 8 also includes zippers 268,270 that allow access to pockets that extend essentially over the entire front panels of the carriers 160,162. In this example, the pocket on carrier 160 includes a mesh window 272 to provide acoustic transparency for an audio device such as a wireless Bluetooth speaker that may be placed in the pocket.

As shown in FIG. 8, the footwear carrying system is attached to a backpack 274 by connecting the loops 188,198 of the shoulder straps to the top handle 276 of the backpack. This is accomplished by releasing the buckles 190,202, threading the ends of the straps 184,186 through the handle 276, then reconnecting the buckles 190,202. This allows the carriers 160,162 to be suspended securely from the backpack while the flexible connection 208,210,212 allows the carriers to pivot, twist and otherwise move independently to accommodate the contour and movement of the backpack, the wearer, etc.

FIG. 9 is side view of the embodiment of FIGS. 5 and 8 attached to a backpack according to some inventive principles of this patent disclosure. In the view of FIG. 9, the footwear carrying system is attached to the backpack 274 in a slightly different way with the loop at the end of the strap 186 pulled up tight to the handle 276 of the backpack using strap adjustability in the buckle 202. The strap 186 of carrier 162 is then passed through the shoulder strap 278 of the backpack 274 to keep it out of the way. The shoulder strap 278 of the backpack is adjusted with slide 280. The other side of the backpack and carrier 160 are arranged in a similar manner.

FIG. 10 illustrates how the embodiment of FIGS. 5 and 8 may be worn by a person according to some inventive principles of this patent disclosure. The carriers 160,162 are worn in the manner of a backpack with the carriers 160,162 suspended from the wearer's shoulders using straps 184,186. The position of the carriers on the wearer's body may be adjusted using slides 196,204,222,224 as shown in FIGS. 5 and 7 and any adjustability that may be included in the buckles 190,202. As with accessory mode, when the footwear carrying system is used in backpack mode as shown in FIG. 10, the flexible connection 208,210,212 allows the carriers to pivot, twist and otherwise move independently to accommodate the contour and movement of the wearer.

FIG. 11 illustrates how an embodiment of a footwear carrying system may be attached to a bicycle rack bag according to some inventive principles of this patent disclosure. The embodiment of FIG. 11 is similar to that of FIGS. 5 and 8 and is suspended vertically from the handle 284 of a rack bag 286 on bicycle 282. The carriers 160,162 are attached to the handle 284 by strap loops 188,198.

Figure 12:
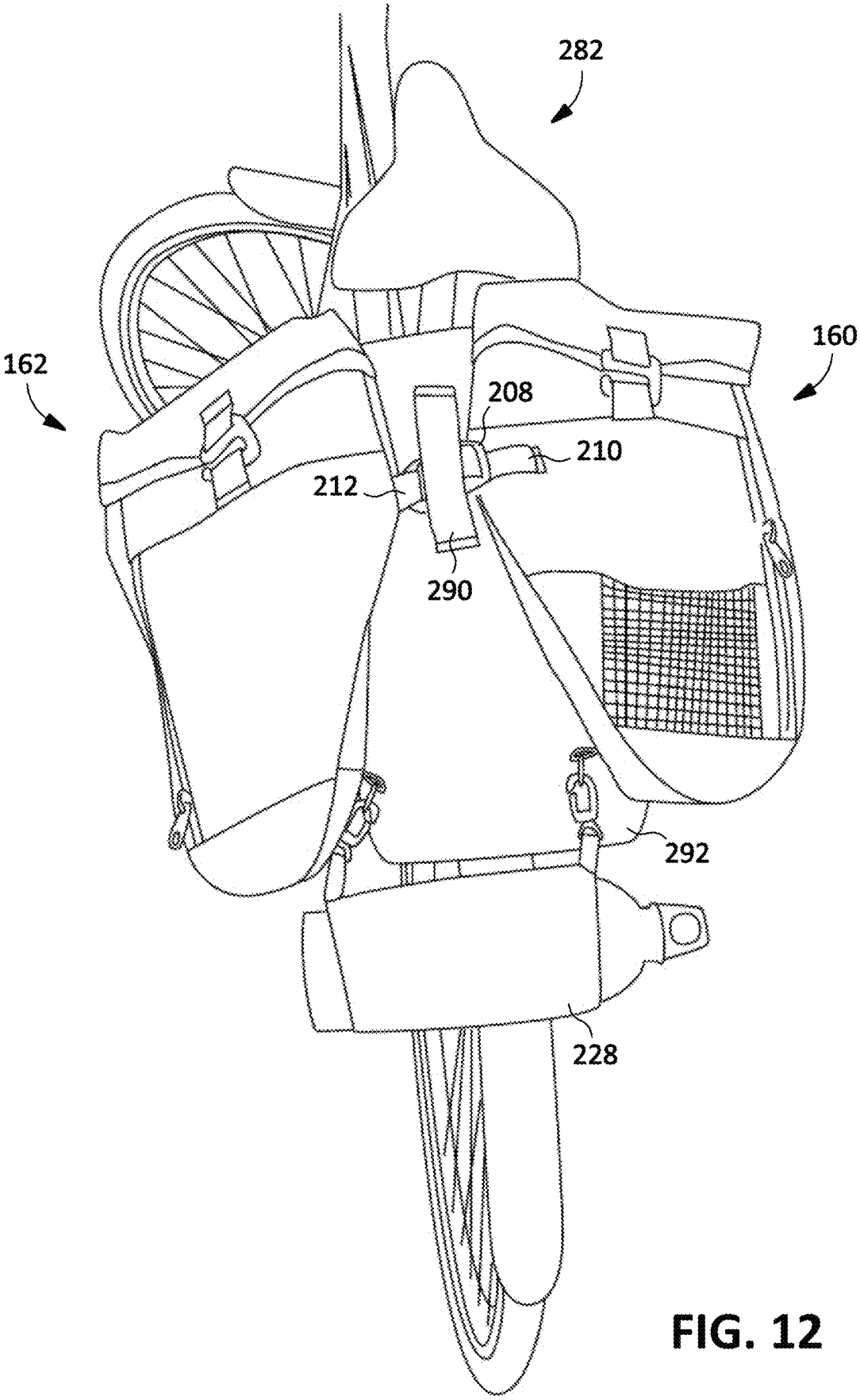
FIG. 12 illustrates another embodiment of a method for suspending a footwear carrying system from a bicycle bag according to the inventive principles of this patent disclosure.

FIG. 12 illustrates another manner in which an embodiment of a footwear carrying system may be attached to a bicycle rack bag according to some inventive principles of this patent disclosure. In this embodiment, the carriers 160,162 are suspended from the handle 290 of a bicycle rack trunk bag 292. The carriers are attached to the handle 290 using the flexible connection 208,210,212 which allows the carriers to pivot, twist and otherwise move independently to accommodate the contour and movement of the trunk bag 292.

The method illustrated in FIG. 12 may also be used to suspend the footwear carriers from other types of carriers such as purses, duffle bags, shoulder bags, etc. The user positions each of the footwear carriers 160,162 on opposite sides of the other carrier and uses the hook 208 to connect the straps 210,212 across the top of the other carrier, preferably through a handle on the other carrier. In the case of a carrier have a shoulder strap such as a courier bag, shoulder bag, or duffle bag with a shoulder strap, the shoulder strap essentially functions as the handle, and the connection 208,210,212 simply lays across the top of the other carrier. Embodiments having adjustability in the connection 208,210,212 may provide additional versatility to accommodate carriers having different widths.

Figure 13:
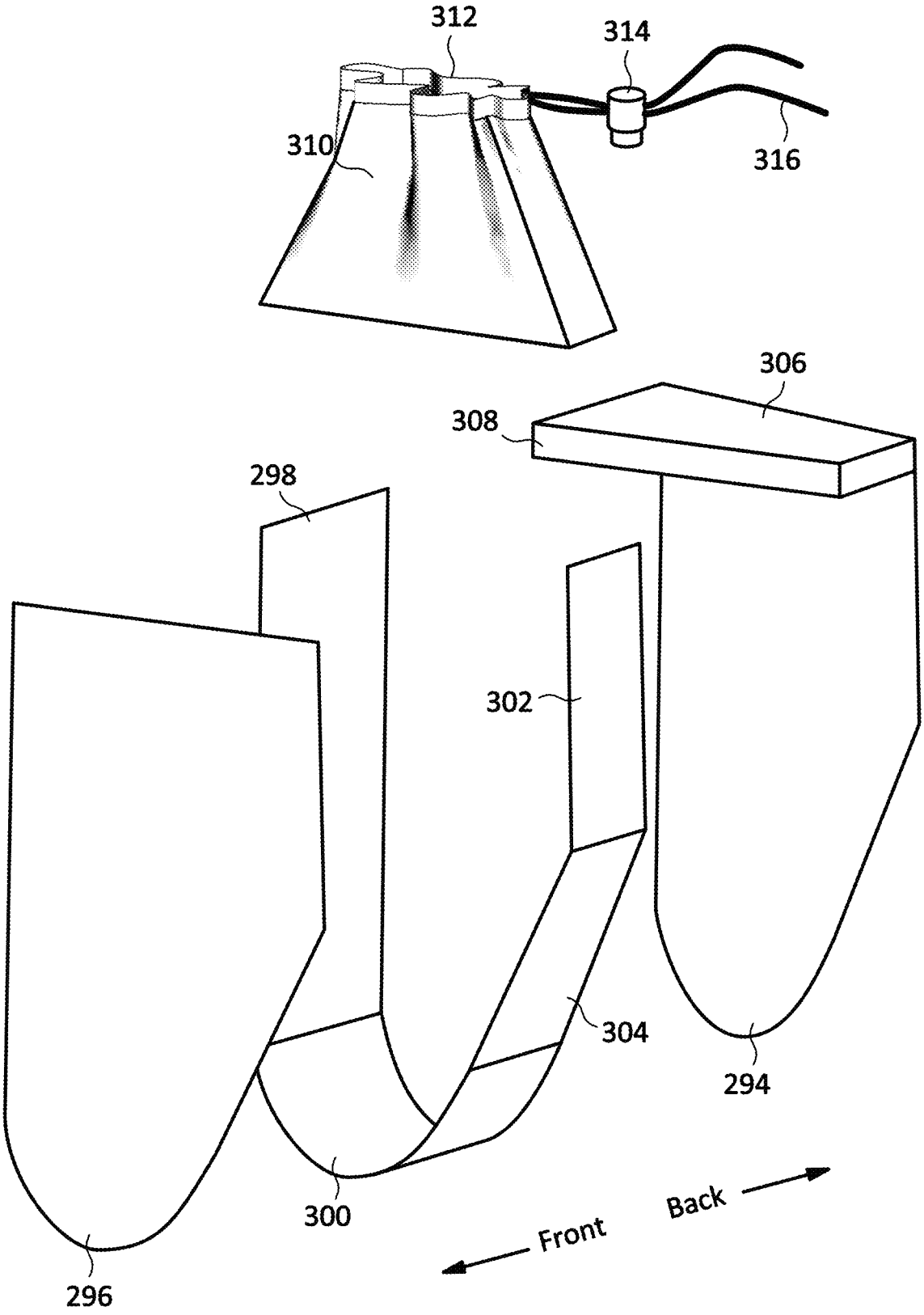
FIG. 13 illustrates some components of an example embodiment of a footwear carrier according to the inventive principles of this patent disclosure.

FIG. 13 is a partially exploded view illustrating some components of an example embodiment of a footwear carrier according to some inventive principles of this patent disclosure. The embodiment of FIG. 13 may be used as one of the carriers 102,104,160,162 in any of the embodiments described above. It is shown using panels of fabric or other material and does not include seam allowances and other routine fabrication details.

The carrier of FIG. 13 includes a back panel 294, a front panel 296, an outer (or sole) panel 298, a lower (or toe) panel 300, an inner panel 302, and a diagonal (or lace) panel 304. The top cover 306, which is folded and sewn to form a rim 308, is preferably formed integral with the back panel 296 which allows it to pivot like a hinge at the interface between the two panels.

In a preferred embodiment, the diagonal (lace) panel 304 may be made from mesh to provide ventilation and breathability, but any other panel or portion may be made from mesh as well. A flap of fabric or other material may be attached inside the carrier to prevent water from entering the back through the mesh.

A cinch cuff or skirt 310 may be included at the top of the carrier and under the cover 306 to provide additional protection from water, UV light, etc. The cuff may include a hem 312 that encloses a drawstring 314 that may be secured in the closed position by a cord stop or toggle 316. Many alternative configurations are possible. For example, the hem 312 may be replaced by a series of grommets or eyelets, or the drawstring may be replaced with elastic.

A cleat protector made from a sheet of rigid or semi-rigid plastic may be sewn in permanently along the outer (sole) panel 298 or it may be removably attached with hook-and-loop fasteners, loops of webbing or elastic, etc.

A pocket for miscellaneous articles, but especially for a battery, may be sewn to the back side of front panel 296. If a pocket is also included on the front side of front panel 296, a passageway may be included between the two pockets to allow, for example, a USB or other cord to pass between a battery in the back pocket and a phone or other device in the front pocket.

Figure 14:
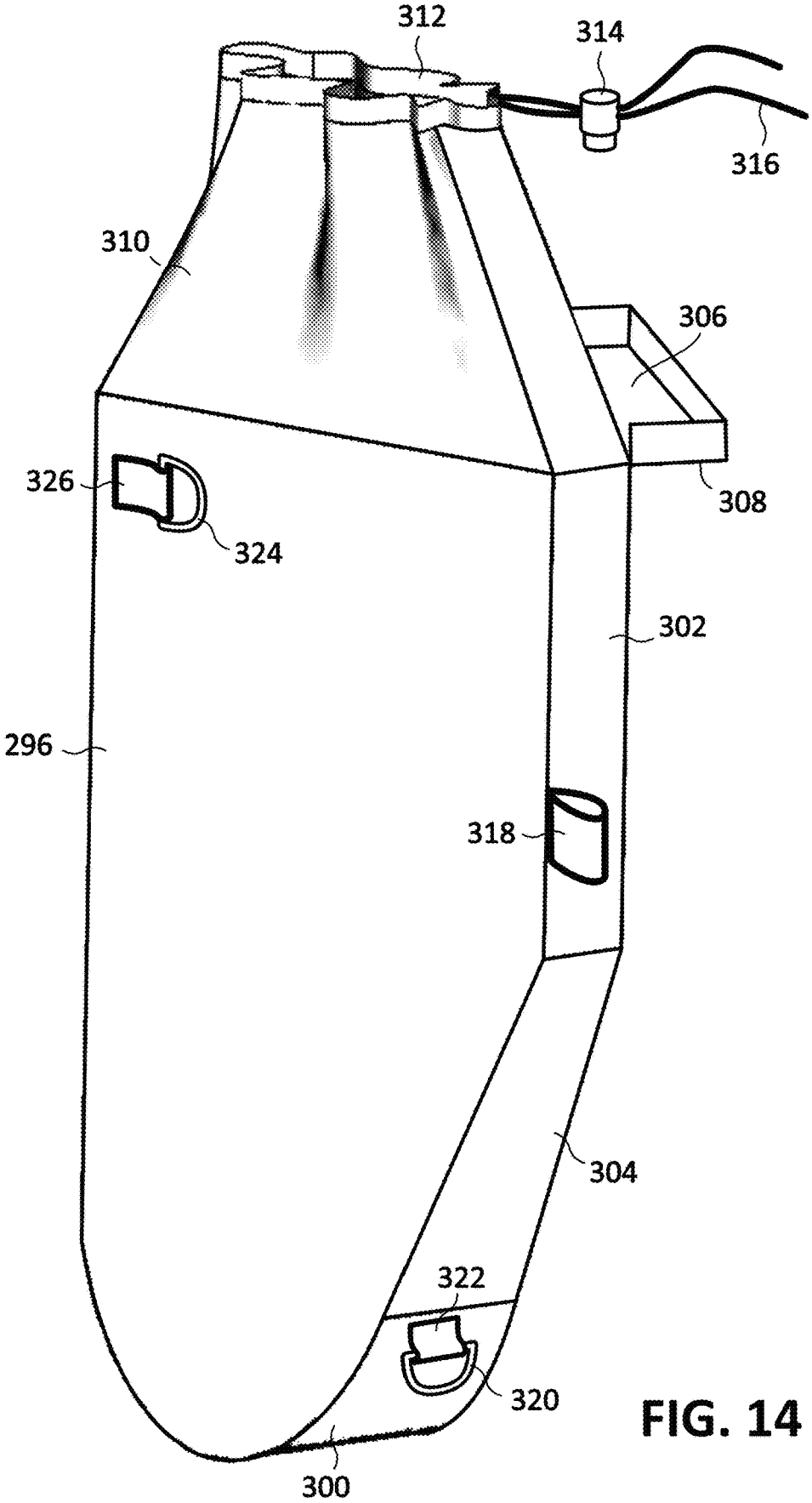
FIG. 14 illustrates another view of some components of an example embodiment of a footwear carrier according to the inventive principles of this patent disclosure.

FIG. 14 illustrates some of the components of FIG. 13 after assembly, as well as the placement of some additional components according to the inventive principles of this patent disclosure. In FIG. 14, the top cover 306 and rim 308 have been rotated to an open position. The cuff 310 is shown extending upward from the rest of the carrier. To rotate the cover 306 and rim 308 to the closed position, the cuff 310 would typically need to be pushed downward until it is flush with the top of the carrier.

A loop of webbing 318 is sewn into the seam between the front panel 296 and inner panel 302. The loop 318 may function as a third attachment point and form part of a connection between two footwear carriers, for example, as loop 212 which connects to strap hook 208 in the embodiment of FIG. 8.

A D-ring 320 is attached to the toe panel 300 with another loop of webbing 322 and may function, for example, as a fourth attachment such as point 138 in in the embodiments of FIGS. 2, 3 and 4, or as point 238 for an accessory carrier 228 as shown in the embodiment of FIG. 5.

Another D-ring 324 is attached to the front panel 296 with another loop of webbing 326 and may function, for example, as a fifth attachment point such as point 148 in the embodiments shown in FIGS. 3 and 4.

Figure 15:
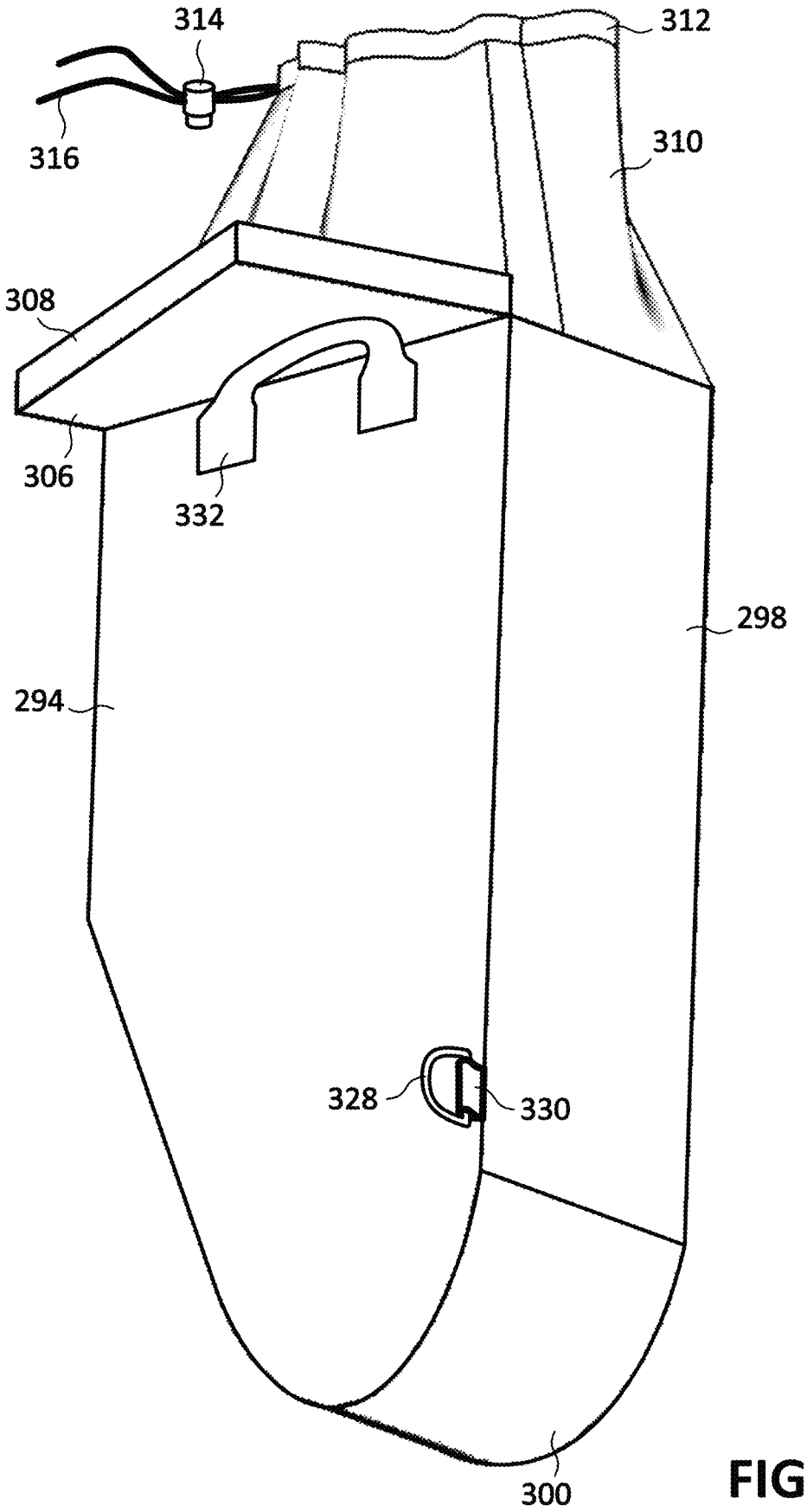
FIG. 15 illustrates another view of some components of an example embodiment of a footwear carrier according to the inventive principles of this patent disclosure.

FIG. 15 is a view from the back side of the embodiment of FIG. 14 and shows a D-ring 328 attached to a loop of webbing 330 that is sewn into the seam between the outer (or sole) panel 298 and the back panel 294. D-ring 328 may serve as a second attachment point such as point 122 in the embodiments shown in FIGS. 1 and 2, or the point 182 shown in the embodiment of FIG. 5.

A loop of sewn fabric 332 is attached at the top of the back panel 294 and may serve as a first attachment point such as point 118 shown in the embodiments shown in FIGS. 1 and 2, or the point 178 shown in any of the embodiments of FIG. 5, 6, 8, 10 or 11.

Although some example details have been described above, the inventive principles may be embodied in many other ways. For example, the footwear carriers need not have an elongated shape, and the walls or panels of the carriers may be implemented in various other numbers, shapes, sizes, etc. Likewise, the connection between the carriers has been shown in some specific locations along the sides of the carrier such as along the inner sidewall, or at the seam between a sidewall and a front panel, it may be arranged in various other positions, and thus, a side may refer to a front, back, inner or outer sidewall, etc. Similarly, some of the attachment points are described as being near an end of a carrier, and this may refer to being near enough to an end to be stable when suspended from a harness, or when suspending an accessory carrier, etc. Additionally, the footwear carriers may be made from transparent materials such as clear vinyl to enable the user to display their shoes while carrying them.

Since the inventive principles of this patent disclosure can be modified in arrangement and detail without departing from the inventive concepts, such changes and modifications are considered to fall within the scope of the following claims.

The invention claimed is:

1. A footwear carrying system comprising:

a first carrier having a first attachment point near a first end of the carrier, a second attachment point near a second end of the carrier opposite the first end, a third attachment point along a first side of the carrier;

a second carrier, separate from the first carrier, having a first attachment point near a first end of the carrier, a second attachment point near a second end of the carrier opposite the first end, and a third attachment point along a first side of the carrier;

a first strap adapted to connect the first and second attachment points of the first carrier; and a second strap adapted to connect the first and second attachment points of the second carrier;

wherein the third attachment points of the first and second carriers are adapted to provide a flexible connection between the first and second carriers;

wherein the flexible connection enables the first and second carriers to move independently of each other;

wherein each of the carriers has an opening at the first end for inserting a shoe into the carrier, and a cover arranged to cover the opening;

wherein each of the carriers comprises:

an inner panel connected to the third attachment point; and an outer panel opposite the inner panel;

wherein the outer panels are substantially wider than the inner panels; and wherein the outer panels are substantially parallel.

2. The footwear carrying system of claim 1 wherein:

the first carrier includes a fourth attachment point near the second end of the carrier; and the second carrier includes a fourth attachment point near the second end of the carrier.

3. The footwear carrying system of claim 2 further comprising:

an accessory carrier having:

a first attachment device adapted to connect to the fourth attachment point of the first carrier; and a second attachment device adapted to connect to the fourth attachment point of the second carrier.

4. The footwear carrying system of claim 3 wherein the accessory carrier comprises a bottle carrier.

5. The footwear carrying system of claim 2 wherein:

the first carrier includes a fifth attachment point near the first end of the carrier; and the second carrier includes a fifth attachment point near the first end of the carrier.

6. The footwear carrying system of claim 5 further comprising:

an accessory carrier having:

a first attachment device adapted to connect to the fifth attachment point of the first carrier;

a second attachment device adapted to connect to the fifth attachment point of the second carrier;

a third attachment device adapted to connect to another attachment point of the first carrier; and a fourth attachment device adapted to connect to another attachment point of the second carrier.

7. The footwear carrying system of claim 1 wherein each of the carriers includes:

a back panel; and an outer panel that is substantially narrower than the back panel.

8. The footwear carrying system of claim 1 wherein each of the carriers further includes:

a front panel; and a back panel opposite the front panel;

wherein the front and back panels are substantially wider than the inner and outer panels.

9. The footwear carrying system of claim 1 wherein each of the carriers includes a sleeve and drawstring at the first end arranged to close the opening.

10. The footwear carrying system of claim 1 wherein the first and second attachment points comprise loop devices.

11. The footwear carrying system of claim 1 wherein the third attachment points of the first and second carriers are connected by a detachable fastener.

12. The footwear carrying system of claim 11 wherein the third attachment points of the first and second carriers are connected by an adjustable length strap.

13. The footwear carrying system of claim 1 wherein the first and second straps are adapted to removably attach the first attachment points of the first and second carriers to another carrying device.

14. A footwear carrying system comprising:

a first carrier having a first attachment point near a first end of the carrier, a second attachment point near a second end of the carrier opposite the first end, a third attachment point along a first side of the carrier;

a second carrier, separate from the first carrier, having a first attachment point near a first end of the carrier, a second attachment point near a second end of the carrier opposite the first end, and a third attachment point along a first side of the carrier;

a first strap adapted to connect the first and second attachment points of the first carrier; and a second strap adapted to connect the first and second attachment points of the second carrier:

wherein the third attachment points of the first and second carriers are adapted to provide a flexible connection between the first and second carriers;

wherein the flexible connection enables the first and second carriers to move independently of each other;

wherein each of the carriers has an opening at the first end for inserting a shoe into the carrier, and a cover arranged to cover the opening;

wherein the soles of two shoes inserted into the carriers face outward away from each other:

wherein:

the first carrier includes a fourth attachment point near the second end of the carrier; and the second carrier includes a fourth attachment point near the second end of the carrier:

wherein:

the first carrier includes a fifth attachment point near the first end of the carrier; and the second carrier includes a fifth attachment point near the first end of the carrier. the footwear carrying system further comprising:

an accessory carrier having:

a first attachment device adapted to connect to the fifth attachment point of the first carrier;

a second attachment device adapted to connect to the fifth attachment point of the second carrier;

a third attachment device adapted to connect to another attachment point of the first carrier; and a fourth attachment device adapted to connect to another attachment point of the second carrier;

wherein the accessory carrier comprises a mesh panel.

15. A method comprising:

storing a first item of footwear in a first carrier having a first attachment point near a first end of the carrier, a second attachment point near a second end of the carrier opposite the first end, and a third attachment point along a first side of the carrier;

storing a second item of footwear in a second carrier having a first attachment point near a first end of the carrier, a second attachment point near a second end of the carrier opposite the first end, and a third attachment point along a first side of the carrier, wherein the second carrier is separate from the first carrier;

connecting the third attachment points of the first and second carriers by a flexible connection wherein the flexible connection enable the first and second carriers to move independently of each other; and suspending the first and second carriers by one or more straps connected to one or more of the attachment points on each carrier;

wherein each of the carriers has an opening at the first end for inserting a shoe into the carrier, and a cover arranged to cover the opening; and wherein each of the carriers comprises:

an inner panel connected to the third attachment point; and an outer panel opposite the inner panel;

wherein the outer panels are substantially wider than the inner panels; and wherein the outer panels are substantially parallel.

16. The method of claim 15 wherein suspending the first and second carriers comprises:

suspending the first carrier from a first shoulder of a wearer using a first strap coupled between the first and second attachment points of the first carrier; and suspending the first carrier from a second shoulder of the wearer using a second strap coupled between the first and second attachment points of the second carrier.

17. The method of claim 15 wherein suspending the first and second carriers comprises:

suspending the first carrier from another carrier using a first strap coupled to the first attachment point of the first carrier; and suspending the second carrier from the other carrier using a second strap coupled to the first attachment point of the second carrier.

18. The method of claim 17 wherein the first and second carriers are suspended from the other carrier by loops in the first and second straps.

19. The method of claim 15 wherein suspending the first and second carriers comprises:

positioning each of the carriers on opposite sides of another carrier; and connecting the third attachment points of the first and second carriers through a handle of the other carrier.

* * * * *